US007089617B1

(12) United States Patent
Lauro

(10) Patent No.: US 7,089,617 B1
(45) Date of Patent: Aug. 15, 2006

(54) PILLOWCASE AND PILLOW WITH PILLOWCASE

(76) Inventor: Iris Catherine Wenzel Lauro, 1041 Regal Manor Way, Sun City Center, FL (US) 33573

( * ) Notice: Subject to any disclaimer, the term of this patent is extended or adjusted under 35 U.S.C. 154(b) by 0 days.

(21) Appl. No.: 11/140,334

(22) Filed: May 27, 2005

Related U.S. Application Data

(60) Provisional application No. 60/575,206, filed on May 28, 2004.

(51) Int. Cl.
*A47G 9/10* (2006.01)

(52) U.S. Cl. ..... 5/636; 5/640; 5/645; 5/490

(58) Field of Classification Search ..... 5/636, 5/639, 640, 645, 490
See application file for complete search history.

(56) References Cited

U.S. PATENT DOCUMENTS

| | | | | |
|---|---|---|---|---|
| 1,617,822 | A | 2/1927 | O'Leary | |
| 1,775,061 | A | 9/1930 | Bertha | |
| 2,029,608 | A | 2/1936 | Buchman | |
| 2,118,486 | A * | 5/1938 | Buchman | 5/639 |
| 2,254,603 | A | 9/1941 | Follis | |
| 2,545,970 | A | 3/1951 | Rand | |
| 2,637,861 | A | 5/1953 | Kethledge | |
| 2,700,165 | A * | 1/1955 | Talisman | 5/658 |
| 2,759,200 | A | 8/1956 | Johnston | |
| 2,962,731 | A | 12/1960 | Bounds | |
| 3,148,389 | A | 9/1964 | Lustig | |
| 3,267,496 | A | 8/1966 | Gionet | |
| 3,274,623 | A | 9/1966 | McCarthy | |
| 3,863,283 | A | 2/1975 | Mohr | |
| 4,185,673 | A | 1/1980 | Daniello | |
| 4,222,468 | A | 9/1980 | DeFries | |
| 4,227,270 | A | 10/1980 | Riviera | |
| 4,523,588 | A | 6/1985 | Dolsky | |
| 4,688,286 | A | 8/1987 | Miker, Jr. | |
| 4,754,513 | A | 7/1988 | Rinz | |
| 4,768,245 | A | 9/1988 | Dutton | |
| 4,959,880 | A | 10/1990 | Tesch | |
| D320,522 | S | 10/1991 | Deremia | |
| 5,115,528 | A | 5/1992 | Lamle | |
| 5,138,728 | A | 8/1992 | Aston | |
| 5,168,590 | A | 12/1992 | O'Sullivan | |
| 5,367,731 | A | 11/1994 | O'Sullivan | |
| 5,430,902 | A | 7/1995 | Lewis | |
| 5,509,157 | A | 4/1996 | Story | |
| D392,496 | S | 3/1998 | Boyd | |
| 5,819,347 | A | 10/1998 | Masuda | |
| 5,953,777 | A | 9/1999 | Buck | |

(Continued)

*Primary Examiner*—Michael Trettel
(74) *Attorney, Agent, or Firm*—Charles J. Prescott

(57) ABSTRACT

A pillowcase alone and in combination with a unique pillow design which provides an interior pocket open at an outer margin thereof for receiving and protectively storing small articles or objects such as a watch, jewelry, small personal mementos, notes and cards, photos, soft sculptures and the like. In the preferred embodiment, the pillowcase has a generally rectangular shape adapted to receive and cover two thin pillows together, or alternately, a conventional pillow. A pocket, smaller than the main portion of the pillowcase, formed continuously with, or as an extension of, each side panel of the pillowcase, is sewn together around exposed outer margins thereof. When folded inwardly, the pocket is positioned or tucked within the interior of the pillowcase against a conventional pillow, between or against two thin pillows, or within or against a pillow with a pocket-receiving cavity. The pocket is then open to receive the articles.

11 Claims, 5 Drawing Sheets

U.S. PATENT DOCUMENTS

| | | | | |
|---|---|---|---|---|
| 6,041,458 | A | 3/2000 | Vickers et al. | |
| D430,768 | S | 9/2000 | Hindes | |
| 6,216,297 | B1 | 4/2001 | Lemke | |
| 6,267,638 | B1 | 7/2001 | Connolly et al. | |
| 6,490,743 | B1 | 12/2002 | Adat et al. | |
| D482,923 | S | 12/2003 | Gaines | |
| 6,668,400 | B1 | 12/2003 | Nichols et al. | |
| 6,691,352 | B1 | 2/2004 | Wang | |
| 2005/0229316 | A1* | 10/2005 | Liao | 5/639 |

* cited by examiner

PILLOWCASE AND PILLOW WITH PILLOWCASE

CROSS-REFERENCE TO RELATED APPLICATIONS

Provisional Patent Application 60/575,206 filed May 28, 2004

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to pillows and pillowcases, and more particularly to a pillowcase structured to include an interior pocket for storing small articles.

2. Description of Related Art

Multi-function pillowcases alone and in combination with a pillow having various storage means are well known.

U.S. Pat. No. 2,962,731 to Bounds, disclosed is a pillow in which a hollow core is built and is fastened closed by a pair of flat springs.

U.S. Pat. No. 6,668,400 to Nichols et al., disclosed is a pocket contained within inside hem of bedding in which hem is at the open end of pillow case (as an example a pillow is illustratively shown).

U.S. Pat. No. 6,216,297 to Lemke, disclosed is specifically a travel pillow also used as a carrying case, a travel pillow-suit case with handle or strap.

U.S. Pat. No. 4,222,468 to De Fries, disclosed is a combination portable storage container and headrest constructed using a removable, rigid tube and has a handle for carrying the unit.

U.S. Design Patent No. 397902 to Knorreck, disclosed is an activity pillow for children constructed with various working and removal parts which are covered with a button-down flap.

U.S. Design Patent No. 320522 to Deremiah, disclosed is a combined pillowcase and multiple pillow assembly. It is constructed to receive multiple pillows at one time and is not designed to create an interior compartment.

U.S. Pat. No. 5,138,728 to Aston, disclosed is an interior container insert for pillow, cushions or stuffed toy. The insert is constructed of flexible material and is removable. Once inserted it can be covered with an exterior casing to camouflage its presence. It is independent of any casing.

U.S. Pat. No. 4,688,286 to Miker, Jr., disclosed is a pillow having storage compartment pockets for personal items, wherein the pockets are hidden from view due to the fact that the pockets are placed on the bottom side of the pillow, as there is nothing unique in the structure of the pocket itself to keep it hidden from obvious view. Thus, if the pillow in Miker, Jr. were simply turned over all of the pockets would be totally exposed.

U.S. Pat. No. 3,863,283 to Mohr, disclosed is a pillow with interior storage compartment for first-aid equipment, intended to be stored in a vehicle.

U.S. Design Patent No. 482923 S to Gaines, disclosed is a pillowcase with a security pocket constructed on the exterior.

U.S. Patent No. 627638 to Connolly et al., disclosed is a pillowcase constructed with a flat pocket attached to the exterior for inserting and positioning a child's toy so that it is within sight of child.

U.S. Design Patent No. 346086 to Jones, disclosed is a pillow constructed with a pocket sewn to the exterior.

U.S. Pat. No. 4,185,673 to Daniello, disclosed is an article-carrying bag which doubles as a seat cushion when emptied of articles, preferably equipped with carrying handles.

U.S. Pat. No. 1,617,822 to O'Leary, disclosed is specifically a pillow which is constructed to form a compartment for receiving a receptacle that gives off an aroma such as medicinal preparation assisting in respiratory ailments.

U.S. Pat. No. 2,637,861 to Kethledge, disclosed is a pillowcase in which the object is to efficiently sustain the pillow tick against shifting or displacement.

U.S. Pat. No. 5,168,590 to O'Sullivan, disclosed is a therapeutic pillow cover having compartments, including a central depression region, for receiving hot/cold packs and/or pillow insert supports to adjust thickness, curvature and shape. Pockets are separate items that may or may not be attached.

U.S. Pat. No. 2,545,970 to Rand, disclosed is a pillow case with an opening for inserting a pillow and at the same end are a pair of pockets folded inward, then stitched for intended use of anchoring and concealing inserted pillow.

The present invention, unlike the above patents, is concerned with providing a simple, easily accessible open pocket positioned within the pillowcase and either against the side of a one-piece pillow, between two pillows, or within a central cavity formed partially into one end of the pillow.

This invention relates to improvements in the use of pillows and pillowcases by which a pillowcase of any size, shape or configuration having one or more sleeves or extensions which becomes an obscured compartment when turned inward and tucked (1) between the inside of the pillowcase and against the outside of an inserted pillow of any size, shape or configuration, or (2) inside a single pillow of any size, shape or configuration and having a central cavity extending into the pillow from one end thereof that is inserted into the pillowcase, or (3) between two or more pillows of any size, shape or configuration, that are simultaneously inserted into the pillowcase, creates one or more hidden compartments used to hide or store items such as text notes, greeting cards, photographs, and soft sculptures.

With the use of this pillowcase, any pillow(s) can be converted into one with a hidden compartment(s). Some of the advantages of the invention lie in the simplicity of construction and versatility of use with one or more pillows including those of standard shape, size and thickness as well as those of a variety of shapes, sizes and thickness.

There is easy access to the inner compartment of the pillowcase, although the opening(s) may be hidden from normal viewing. The obscured compartment(s) can remain open in the sense that it is not temporarily fastened by means such as a zipper, snaps, a Velcro-type product, and the like, however it can be fastened by such means. The exterior of pillowcase can be of normal appearance and upon further investigation an opening(s) to an inner compartment(s) can be discovered.

BRIEF SUMMARY OF THE INVENTION

This invention is directed to a pillowcase alone and in combination with a unique pillow design which provides an interior pocket open at an outer end or margin thereof for receiving and protectively storing small objects such as watches, jewelry, small personal mementos, notes and cards, photos, soft sculptures and the like. In the preferred embodiment, the pillowcase has a generally rectangular shape adapted to receive and cover two thin pillows together, or alternately, a conventional pillow. A smaller pocket formed continuously with or as an extension of each side panel of the pillowcase is sewn together around exposed outer margins thereof except for the opening to receive the pillow. When folded inwardly, the pocket is positioned within the interior of the pillowcase and against a conventional pillow, between or against two thin pillows, or within or against a pillow with a pocket-receiving cavity. The pocket is then open and ready to receive the articles.

It is therefore an object of this invention to provide a fabric pillowcase of simple two-panel construction which includes an interior pocket preferably positioned at the normally closed end of an otherwise conventional pillowcase.

Another object of this invention is to provide a pillowcase and uniquely constructed pillow(s) which cooperate with a pocket of the pillowcase as an extension thereof to form an interior pocket extending into, between, or along the pillow (s).

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
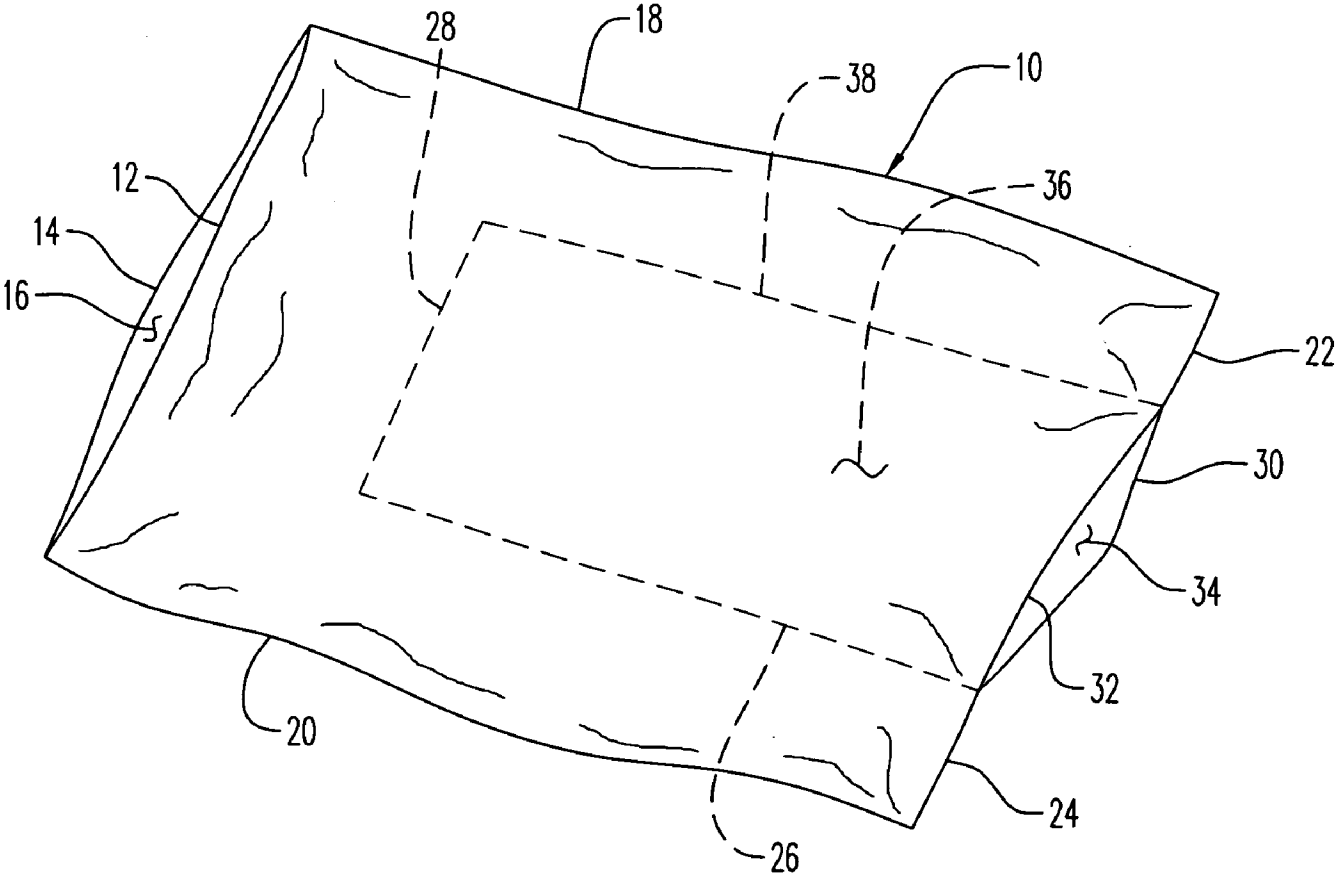
FIG. 1 is a perspective view of the preferred embodiment of the pillowcase.

Referring now to the drawings, and firstly to FIGS. 1, 2, 4 and 5, the preferred embodiment of the pillowcase is there shown generally at numeral 10. The uniquely configured pillowcase 10 formed of two flexible fabric sheets or panels 12 and 14 which are sewn together along entire common side margins 18 and 20 while being left open along one end margin to define an open end 16 thereof.

Figure 2:
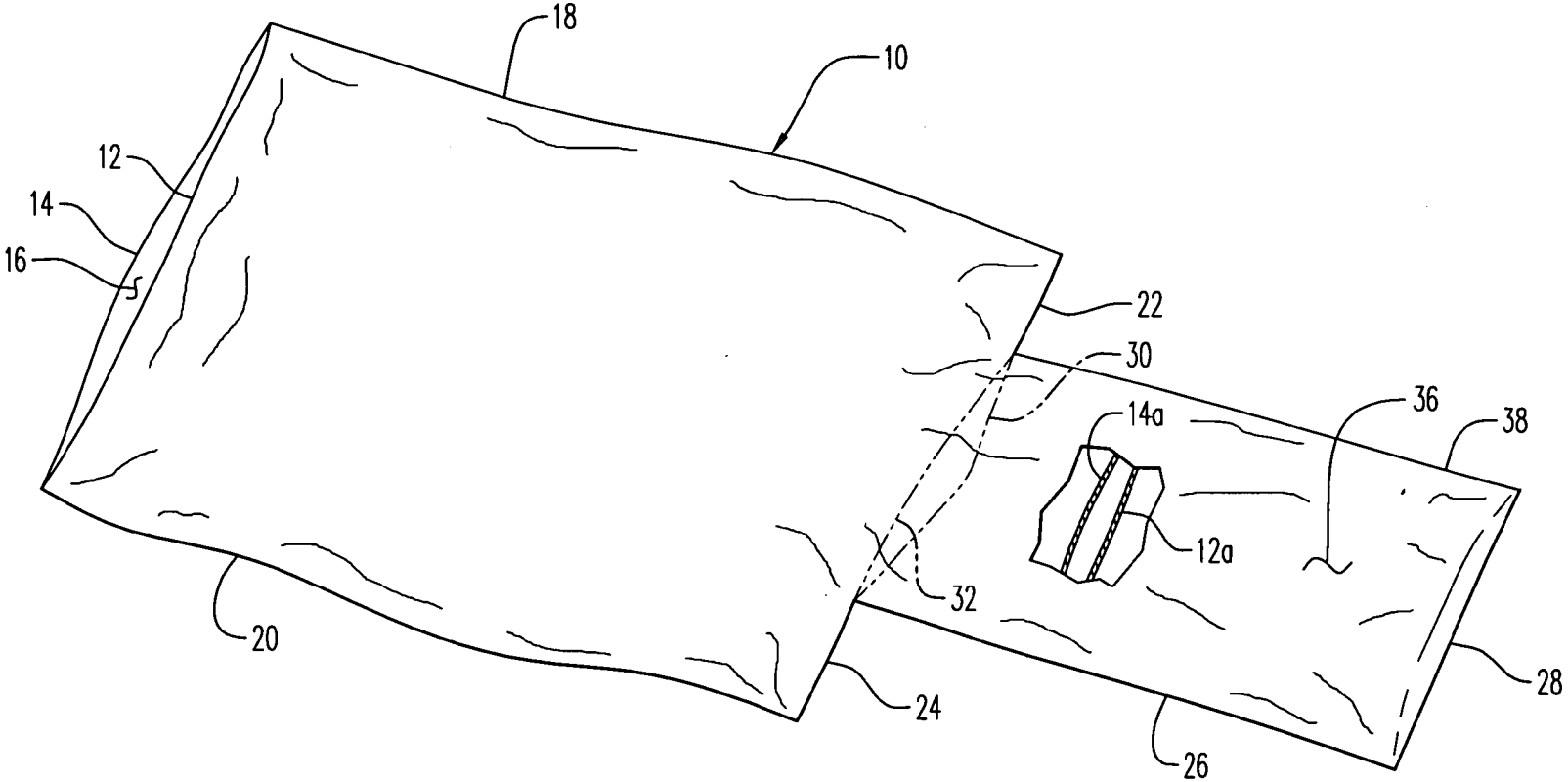
FIG. 2 is a perspective broken view of FIG. 1 showing the pocket extended from within the pillowcase.

As best seen in FIG. 2, the pillowcase 10 includes an extension 36 formed of extended or connecting panels 12*a* and 14*b* extending from the panels 12 and 14 which form the main body of the pillowcase 10. The second end of the pillowcase 10 is sewn closed along second end margin portions 22 and 24 as are the side margins 26, 28 and 38 of the extension 36. Thus, the entire second end and both side margins 18 and 20 of the pillowcase 10 are completely closed by stitching or sewing along the respective common margins 18, 20, 22, 24, 26, 28, and 38.

To turn the extension 36 into an interior pocket, the extension 36 is simply pushed or tucked into and folded along imaginary fold lines 30 and 32 so that the extension 36 now is in the form of an interior pocket entirely within the main body of the pillowcase 10. This folding of the extension 36 into the interior pocket also automatically provides an opening 34 providing access for storing and retrieving small articles as described elsewhere in this specification.

Figure 4:
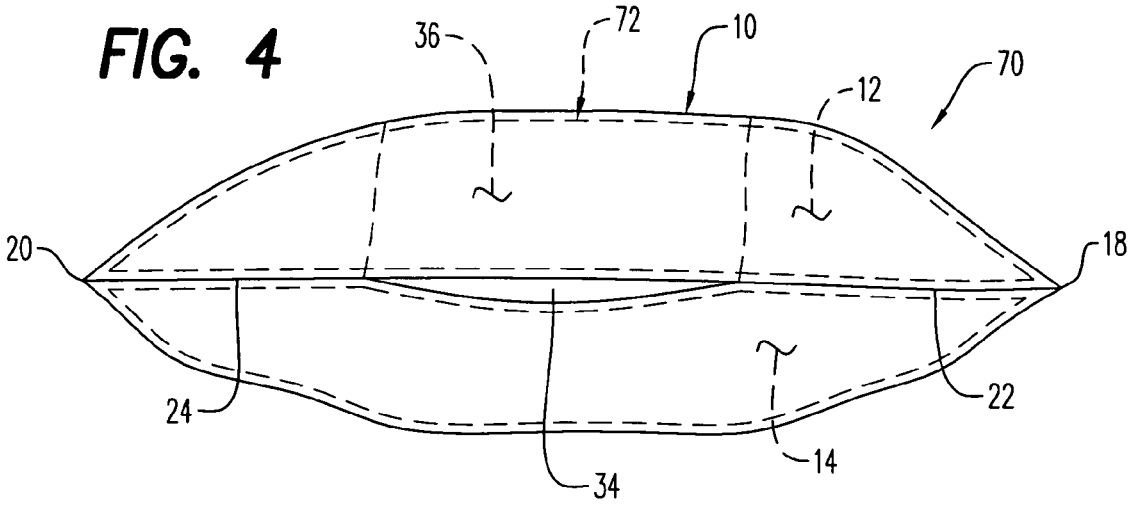
FIG. 4 is an end view of the pillowcase embodiment of FIG. 1 showing a conventional pillow therein.
Figure 5:
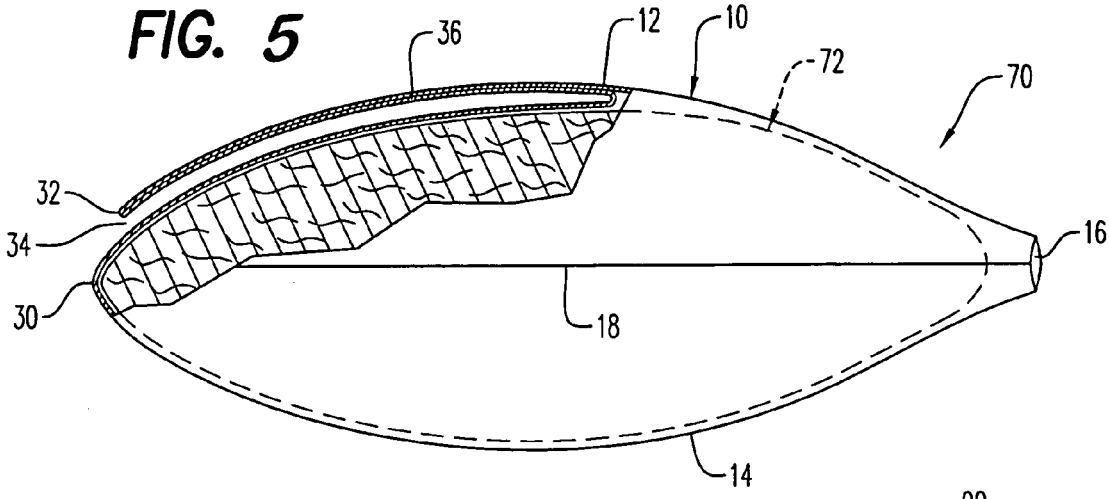
FIG. 5 is a partially broken side elevation view of the pillowcase embodiment of FIG. 1 showing a conventional pillow therein.

As best seen in FIGS. 4 and 5, the pillowcase 10 with pillow 72 is generally shown at numeral 70. After the pillow 72 (of a conventional rectangular design) is inserted within the pillowcase 10 through opening 16, the pocket 36 is then tucked along fold lines 30 and 32 in between one side panel 12 and the outer surface of pillow 72 as previously described. In this configuration ready for use, small articles may be inserted through the opening 34 into the pocket 36.

Figure 3:
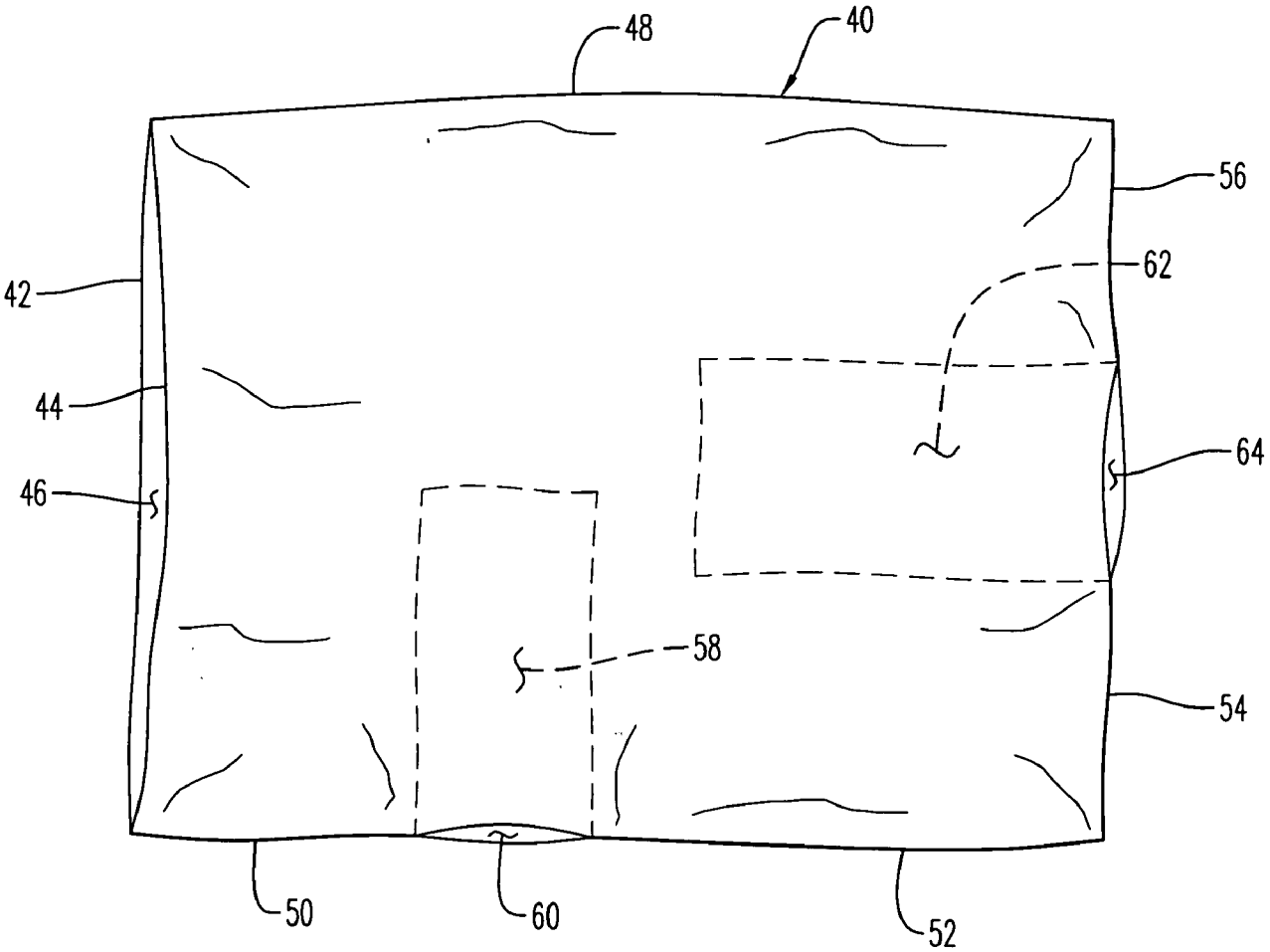
FIG. 3 is a plan view of a multi-pocket embodiment of the invention.

Referring now to FIG. 3, an alternate embodiment of the pillowcase is there shown generally at numeral 40 and includes two rectangular fabric side panels 42 and 44 open at the first end thereof to define the pillow-inserting opening 46 and sewn together along the entire side margin 48 and along side margin segments 50 and 52 of the opposite side margin and along segments 54 and 56 along the opposite end margin thereof.

Extensions 58 and 62, formed as previously described with respect to the embodiment of FIG. 1, are also provided as extensions or continuations of the main pillow panels 42 and 44 and sewn around all three of the common margins thereof to define the pockets 58 and 62 which, when tucked or folded into the pillowcase 40 define the pockets 58 and 62 with respective openings 60 and 64 as previously described.

Figure 6:
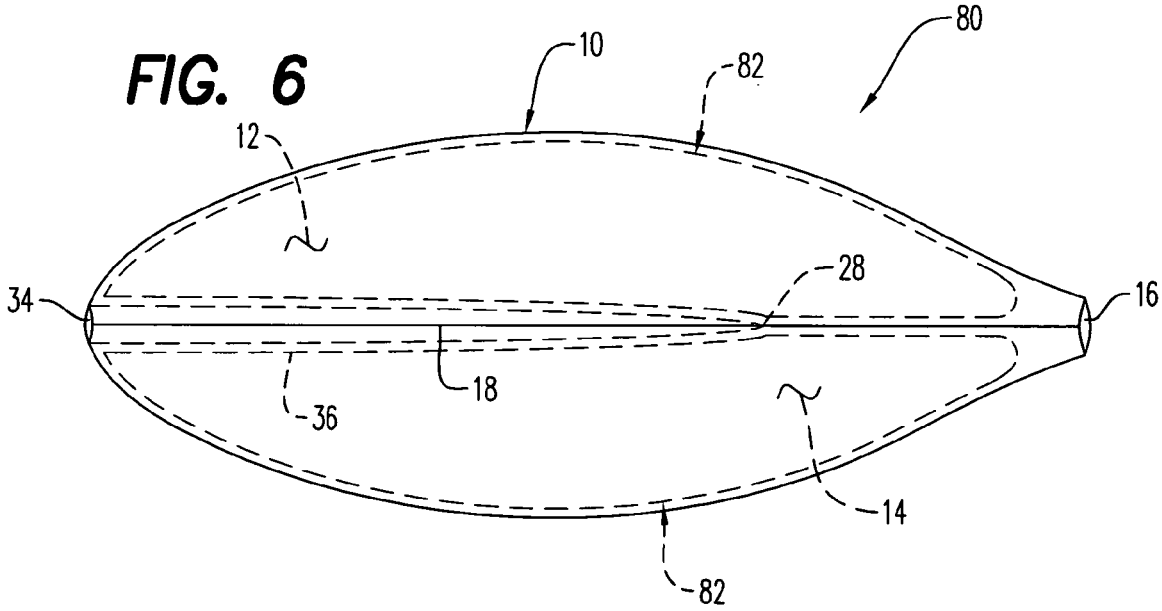
FIG. 6 is a side elevation view of the pillowcase of FIG. 1 in combination with two thin conventional pillows therein

In FIG. 6, another embodiment of the invention is there shown generally at numeral 80 and represents a combination of the pillowcase 10 of FIG. 1 as previously described along with two thin rectangular pillows 82 both of which are inserted into the pillowcase 10 through opening 16 in side-by-side relation. The pocket 36 is then tucked in between the two thinner pillows 82 so as to be centrally positioned therebetween as shown. Opening 34 then provides access to insert and remove smaller objects into and from the pocket 36 and to provide an equal level of pillow material on either side of the pocket 36 so that the articles placed therein are padded regardless of which way the pillow 80 is turned for head resting and sleeping.

Figure 7:
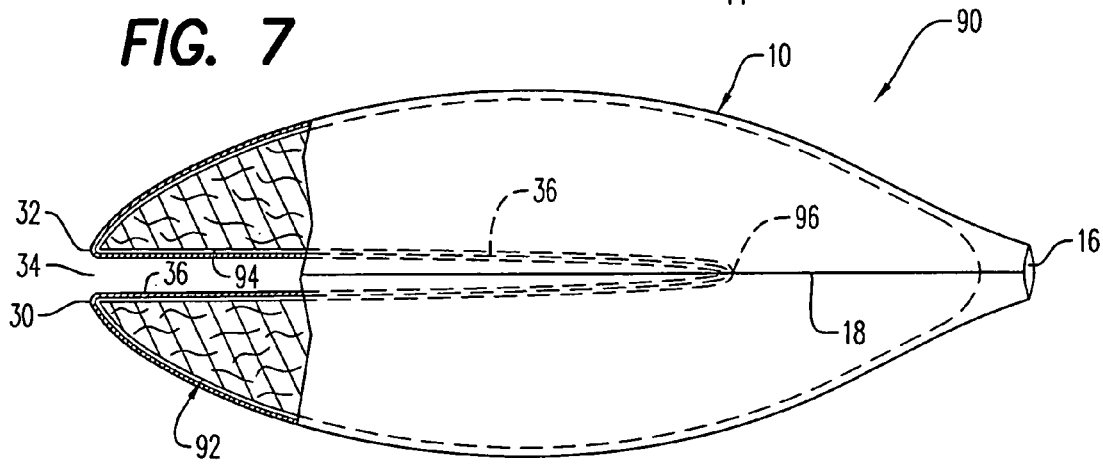
FIG. 7 is a partially broken side elevation view of the pillowcase embodiment of FIG. 1 in combination with a uniquely configured pillow therein.

Referring to FIG. 7, another combination pillowcase and pillow is there shown generally at numeral 90. The pillowcase 10 is as previously described; however, the pillow 92, generally sized as a conventional rectangular pillow similar to the one described in FIGS. 4 and 5. However, this pillow 92 includes its own centrally positioned longitudinally extending rectangular cavity 94 which terminates at 96, a distance from the opening 34 generally equal to the depth or length of the pocket 36. By this arrangement, because of the width of the cavity 94, additional space is provided, particularly for flat objects such as notes and cards and providing ease of insertion of the pocket 36 into the cavity 94.

Figure 8:
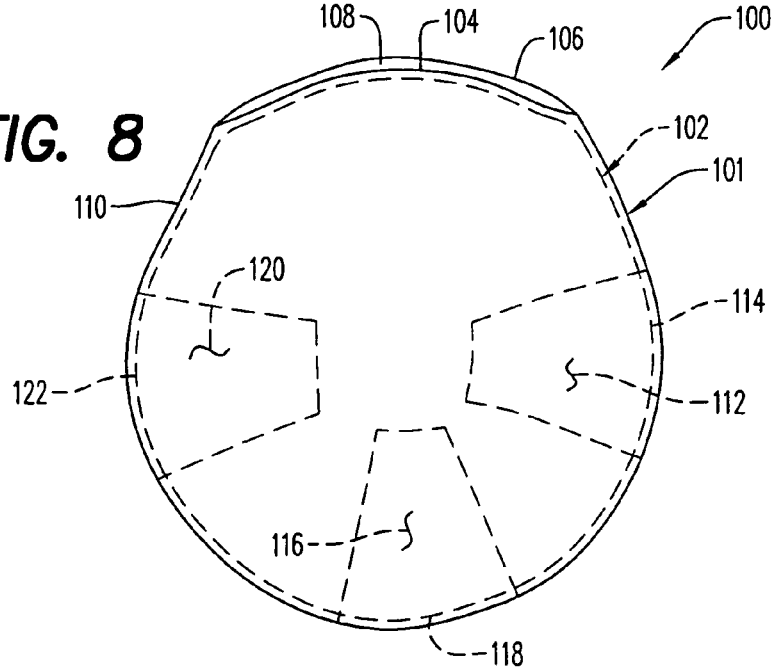
FIG. 8 is a plan view of another multi-pocket embodiment of the invention showing a conventional round pillow therein.

Lastly, in FIG. 8, the invention is demonstrated to be easily adapted to virtually any shape of pillow, in this case, a combination round pillow 102 and matching pillowcase 101 in combination shown generally at numeral 100. Again, the pillow 102 is generally round and pancake in shape while the pillowcase 101 includes opening 108 for receiving the pillow 102 therethrough. Fabric panels 104 and 106 are sewn together along the common margin 110 except at openings 114, 118 and 122 corresponding to pockets 112, 116 and 120, respectively, which are constructed as previously described.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A pillowcase comprising:

two fabric side panels connected together along common side margins and unconnected along common first end margins thereof, said open end adapted to receive a pillow;

common second end margins of said fabric panels also connected together and having a central portion thereof laterally offset from outer portions of said second end margins to define an extension of said side panels which, when folded or tucked inwardly within said pillowcase, defines an open pocket for receiving small articles therein.

2. A pillowcase as set forth in claim 1, further comprising:

the pillow;

said pillowcase and said pillow rectangular in shape.

3. A pillowcase as set forth in claim 2, wherein:

said pillow includes a flat cavity extending longitudinally into one end thereof, said cavity sized to receive said pocket fully tucked and positioned therein.

4. A pillowcase as set forth in claim 2, wherein:

said pillow includes two separate thin pillows generally sized to equal a single conventional pillow and positionable against one another within said pillowcase, said pocket being positionable and fully extendable between said thin pillows.

5. A pillowcase as set forth in claim 1, wherein:

said pillowcase and pillow are round in shape.

6. A pillowcase in combination with a pillow comprising:

a pillow;

two fabric side panels connected together along common side margins and unconnected along common first end margins thereof, said open end adapted to receive said pillow;

common second end margins of said fabric panels also connected together and having a central portion thereof laterally offset from outer portions of said second end margins to define an extension of said side panels which, when folded or tucked inwardly within said pillowcase and against said pillow, defines a pocket with an opening for receiving small articles therein.

7. A pillowcase as set forth in claim 6, wherein:

said pillowcase and said pillow are rectangular in shape.

8. A pillowcase as set forth in claim 7, wherein:

said pillow includes a flat cavity extending longitudinally into one end thereof, said cavity sized to receive said pocket fully inserted there into.

9. A pillowcase as set forth in claim 6, wherein:

said pillow includes two separate thin pillows positionable against one another within said pillowcase, said pocket being positionable and fully insertable between said thin pillows.

10. A pillowcase as set forth in claim 6, wherein:

said pillowcase and pillow are round in shape.

11. A pillowcase in combination with a pillow comprising:

a pillow;

two fabric side panels connected together along common side margins and unconnected along common first end margins thereof, said open end adapted to receive said pillow;

common second end margins of said fabric panels also connected together and having a central portion thereof laterally offset from outer portions of said second end margins to define an extension of said side panels which, when folded or tucked inwardly within said pillowcase and against said pillow, defines a pocket with an opening for receiving small articles therein;

said pillow includes two separate thin pillows positionable against one another within said pillowcase, said pocket being positionable and fully insertable between said thin pillows.

* * * * *